US005978491A

United States Patent [19]

Papadopoulos

[11] Patent Number: 5,978,491

[45] Date of Patent: Nov. 2, 1999

[54] CIRCUITRY FOR IMPROVING PERFORMANCE OF ELECTRET MICROPHONE

[75] Inventor: Costas Papadopoulos, Acton, Mass.

[73] Assignee: VXI Corporation, Rollinsford, N.H.

[21] Appl. No.: 08/968,307

[22] Filed: Nov. 12, 1997

Related U.S. Application Data

[60] Provisional application No. 60/033,339, Nov. 21, 1996.

[51] Int. Cl.[6] ..... H04R 3/00

[52] U.S. Cl. ..... 381/113; 381/111; 381/92

[58] Field of Search ..... 381/113, 114, 381/111, 92, 26, 369, 190; 330/277

[56] References Cited

U.S. PATENT DOCUMENTS

| | | | |
|---|---|---|---|
| 3,862,367 | 1/1975 | Kono | 381/113 |
| 4,160,881 | 7/1979 | Smulders . | |
| 4,280,018 | 7/1981 | Lazarus | 381/114 |
| 4,331,840 | 5/1982 | Murphy et al. . | |
| 4,418,246 | 11/1983 | Sawyer . | |
| 4,764,690 | 8/1988 | Murphy et al. . | |
| 5,083,095 | 1/1992 | Madaffari | 330/277 |

OTHER PUBLICATIONS

Murphy et al., IEEE Transactiong on Electrical Insulation, "Subminiature silicon integrated electret capacitor microphone", vol. 24, No. 3, pp. 495–498, Jun. 1989.

Fraim et al., Journal of the Audio Engineering Society, "Miniature electret microphones", vol. 18, No. 5, pp. 511–517, Oct., 1970.

Fraim et al., Journal of the Acoustical Society of America, "Electrets in miniature microphones", vol. 53, No. 6, pp. 1601–1608, 1973.

Murphy et al., 1985 IEEE. Reprinted with permission from 5th Int'l. Symposium on Electrets, (IS5), "Subminiature hearing aid microphones", pp. 732–737, Sep. 4–6, 1985, Heidelberg, West Germany.

Product specificaiton sheet for Professional Boom Microphones, Model 736 from Lectret S.A., 25 Pr. Champs–Fréchets, CH–1217, Meyrin–Genéve.

*Primary Examiner*—Minsun Oh Harvey

*Attorney, Agent, or Firm*—Samuels, Gauthier & Stevens, LLP

[57] ABSTRACT

In one embodiment of the invention there is provided an electret microphone circuit including an electret microphone including a field effect transistor (FET) having a gate coupled to an electret element, a drain coupled to provide audio frequency output to an audio output node, and a source coupled to ground via a first resistor so as to reduce drain current swings; and an RLC circuit coupled to the drain for configuring the audio frequency output from the drain to desired characteristics. In an alternative embodiment there is provided a circuit coupled to said FET for operating said FET in a source follower mode so as to create low output impedance. In another embodiment of the invention there is provided a method of improving performance of an electret microphone, the microphone including a field effect transistor (FET) having a gate coupled to an electret element, a drain coupled to provide audio frequency output to an audio output node, and a source. The method includes coupling the source to ground via a first resistor so as to reduce drain current swings; and operating the FET in a source follower mode so as to create low output impedance. In another embodiment there is provided a step of configuring the audio frequency output from the drain to desired characteristics.

21 Claims, 3 Drawing Sheets

FIG. 1
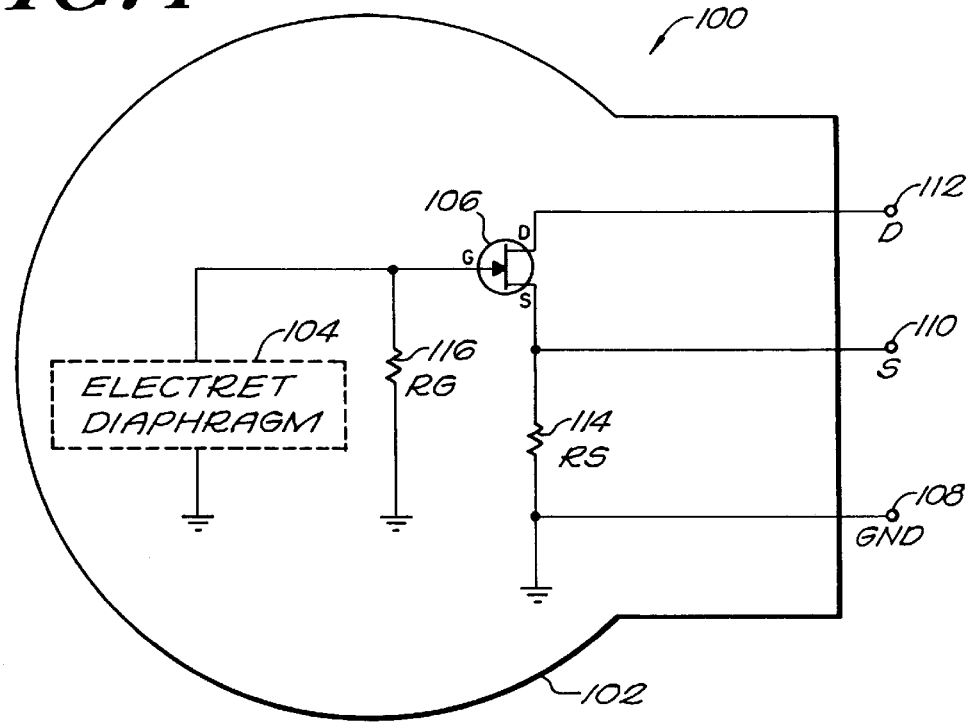
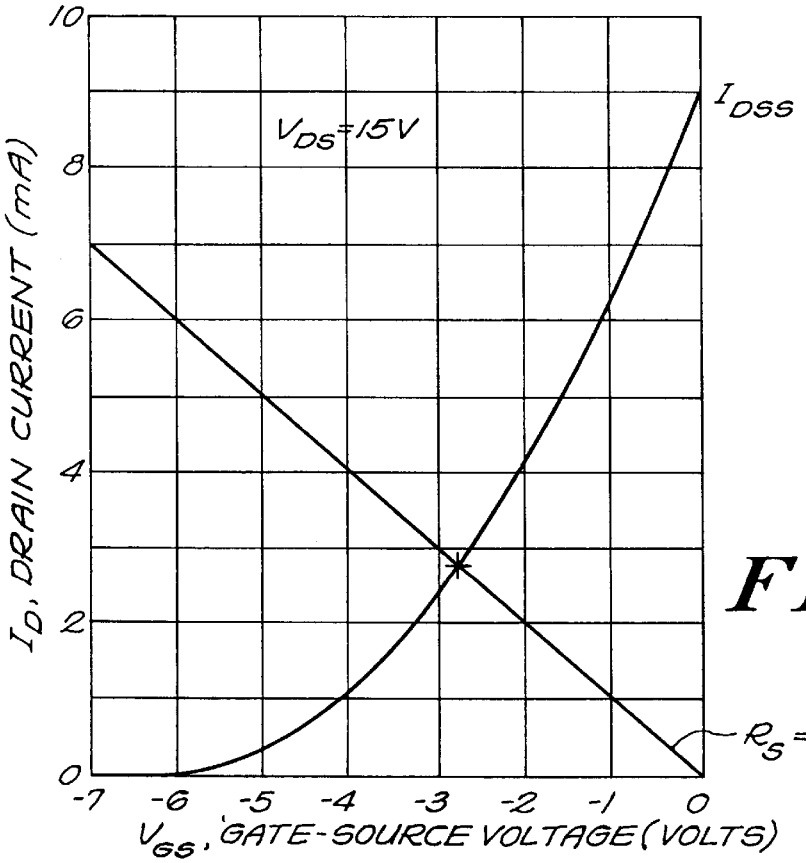
FIG. 2

CIRCUITRY FOR IMPROVING PERFORMANCE OF ELECTRET MICROPHONE

PRIORITY

This application claims priority from provisional application Ser. No. 60/033,339 filed Nov. 21, 1996.

BACKGROUND OF THE INVENTION

The invention relates to a circuitry which improves performance of a low cost electret microphone.

Electret microphones are preferred in many applications for their small size, light weight and high output. They are manufactured in numerous acoustic configurations, but generally fall in one of three categories in terms of electronic circuitry: two-terminal simple, three-terminal intermediate and three-terminal advanced. The electret element is enclosed in a housing together with a buffer amplifier, most commonly a JFET stage. A voltage bias source is therefore required for the JFET amplifier and is provided by the equipment the microphone is connected to.

The two-terminal simple electret mic is a modest, low cost device suitable for consumer electronic appliances and telephones, where any limitations in acoustic to electrical conversion are masked by bandwidth shaping (often mandated by FCC rules) or the ability of a human listener to comprehend speech with moderate distortion. The mic housing contains the absolute minimum necessary for operation, an electret diaphragm and a JFET. One side of the charged electret is grounded to the case, the opposite side is internally coupled to the JFET gate. The source is brought outside as one of the two terminals but is grounded to the case. The other terminal is the JFET drain. A typical two-terminal electret mic is the Panasonic WM-54BT.

The three-terminal advanced electret mic has additional circuitry, typically resistors and sometimes also capacitors mounted on a hybrid circuit board together with the electret and the FET. The greater complexity and cost are offset by higher performance, particularly greater intelligibility and lower distortion. Applications for these microphones are in speech recognition, hearing aids, military communications, and music. FIG. 1 is a schematic diagram of a three terminal electret mic 100. The mic 100 includes a grounded housing 102, an electret diaphragm element 104 and a JFET transistor 106. The mic has three terminals: ground 108, FET source 110 and drain 112 enclosed in the grounded housing. Most commonly, the drain is directly connected to the bias voltage source or battery and the JFET 106 is used as a source follower for low output impedance. Typical ranges for biasing resistors 114 and 116 are several megohms and several hundred ohms respectively. Gentex Model 3065 is a representative advanced electret microphone.

The intermediate three-terminal electret is simpler than the advanced by avoiding the hybrid circuit board but still brings out the JFET source connection separately. Primo EM-60P is such a microphone.

SUMMARY OF THE INVENTION

In one embodiment of the invention there is provided an electret microphone circuit including an electret microphone including a field effect transistor (FET) having a gate coupled to an electret element, a drain coupled to provide audio frequency output to an audio output node, and a source coupled to ground via a first resistor so as to reduce drain current swings; and an RLC circuit coupled to the drain for configuring the audio frequency output from the drain to desired characteristics. In an alternative embodiment there is provided a circuit coupled to said FET for operating said FET in a source follower mode so as to create low output impedance.

In another embodiment of the invention there is provided a method of improving performance of an electret microphone, the microphone including a field effect transistor (FET) having a gate coupled to an electret element, a drain coupled to provide audio frequency output to an audio output node, and a source. The method includes coupling the source to ground via a first resistor so as to reduce drain current swings; and operating the FET in a source follower mode so as to create low output impedance. In another embodiment there is provided a step of configuring the audio frequency output from the drain to desired characteristics.

BRIEF DESCRIPTION OF THE DRAWINGS

FIG. 1 is a schematic diagram of a three terminal electret mic;

FIG. 2 is a graph of the drain current versus gate to source voltage for a two terminal electret mic;

DETAILED DESCRIPTION OF THE ILLUSTRATED EMBODIMENTS

It will be shown that in accordance with the invention, the performance of a two-terminal electret mic can be enhanced in steps, utilizing several techniques and it will become evident that some of these steps can be beneficially applied to three-terminal devices.

When a JFET is connected such that the source is grounded by definition, the DC operating point is at the steepest, least stable region of the drain current versus gate to source voltage curve, point $I_{DSS}$ in the graph of FIG. 2. Small voltage swings at the gate induced by soft speech will result in a nearly linear current swing at the drain. Louder speech, breath "pops" and physical jolts will cause large drain current swings.

When the instantaneous value of gate voltage is large and positive the drain current is extremely high, because of forward conduction in the gate junction. This is the "forbidden" quadrant of the $I_D$ VS. $V_{GS}$ curve. When the gate voltage swing is large and negative, the drain current is significantly reduced and may even reach cut-off. In either case the resulting audio distortion begins quickly but recovers slowly due to the very high impedance at the gate. The phenomenon may easily be observed with a DC milliammeter: the quiescent $I_{DSS}$ current will increase or decrease quickly when a word such as "bang" is spoken into the microphone, but returning to normal will take several seconds. Speech recognition by computer software is adversely affected by this behavior and one may erroneously resort to an attenuator at the mic output in order to reduce the large swings in audio level, causing further degradation.

Figure 3:
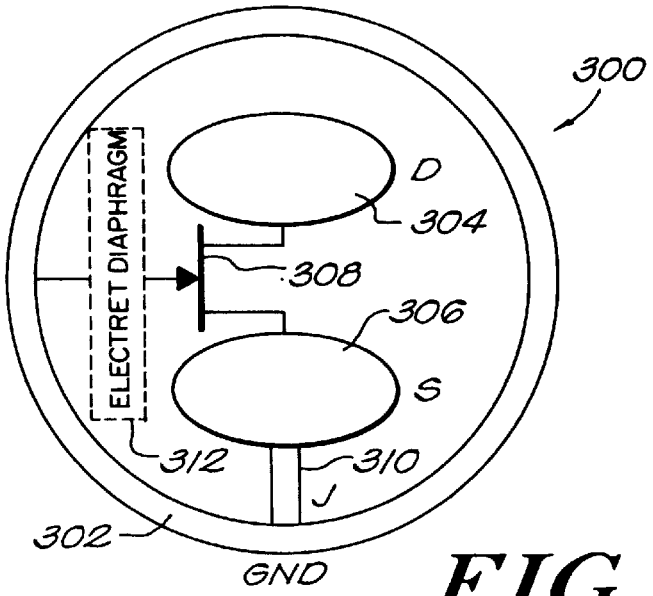
FIG. 3 is a bottom view of an exemplary two-terminal electret mic.

The following technique can be applied to a two-terminal electret mic as shown in FIG. 3 in order to separate the source terminal and use it to advantage. FIG. 3 is a bottom view of an exemplary two-terminal electret mic 300. The mic package consists of an aluminum can with a printed circuit board lid. On the lid is etched a pattern such as a full circular ring of copper 302 (GND in FIG. 1) at the circumference of the board with two oval pads 304 and 306 (S and D) of copper inside connected to the source and drain of a JFET transistor 308. A jumper track 310 (J) connects the oval pad 306 (S) to the ring 302. An electret diaphragm element 312 is coupled to the gate of JFET 308. When the can is crimped to the lid, the source is grounded or pad 306 is connected to GND ring 302 by jumper 310. Cutting or abrasively removing the jumper 310 from the circuit board makes the source terminal available independently.

The first electrical step to be followed once the source is freed is to connect to ground via a resistor $R_S$. This will immediately reduce the drain current swings described before and move the quiescent point from $I_{DSS}$ to the intersection with the load line of $R_S$ in the graph of FIG. 2 where the $I_D$ slope is less steep. The JFET can now be used in the source follower mode for low output impedance. The benefits are lower voltage operation and longer battery life since the drain current has been reduced.

The maximum voltage gain of a source follower is 1. If more gain is desired, the FET can be operated in the common source mode, as before cutting the jumper 310, by also adding a capacitor from source to ground. The capacitor must be at least large enough to bypass $R_S$ above the lowest audio frequency of interest. For instance 1 $\mu$F and 1 kΩ will be effective for frequencies above 159 Hz. If it is assumed that $R_D$ is 2 kΩ, then voltage gain at the drain output is $A_V=R_D/R_S=2000/1000=2$, without the capacitor, which however at 159 Hz becomes $A_V=R_D/Z_S=2000/500=4$ or 6 dB greater when the capacitor is added.

Even though electrets may have a high-pass frequency response with reduced sensitivity at this low frequency, it is advantageous to use even higher capacitance, say 10 $\mu$F, at the source. Higher capacitance is beneficial because the resulting slower source RC time constant will further improve transient response. In the DC milliammeter procedure described above no sudden changes will be observed and current perturbations will be small. Thus, intelligibility and speech recognition will be enhanced. In addition to higher audio output from the drain, the earlier benefits of lower voltage operation and longer battery life (than when the source was DC grounded) are still retained.

The voltage gain of a common source FET amplifier is $A_v=g_mR_D$ or transconductance times drain resistance, assuming the source is AC grounded. Transconductance is fixed by the DC operating conditions. Higher drain resistance results in higher gain up to a point and eventually the greater drop through RD starves the drain to source voltage. More rigorously, instead of RD, one can consider the impedance connected to the drain. Voltage gain is proportional to this impedance. A combination of RLC components can result in higher gain and therefore grater mic sensitivity without voltage starvation. This is accomplished by passing the drain current through an inductor which has inherently low resistance and therefore low DC voltage drop.

Figure 4:
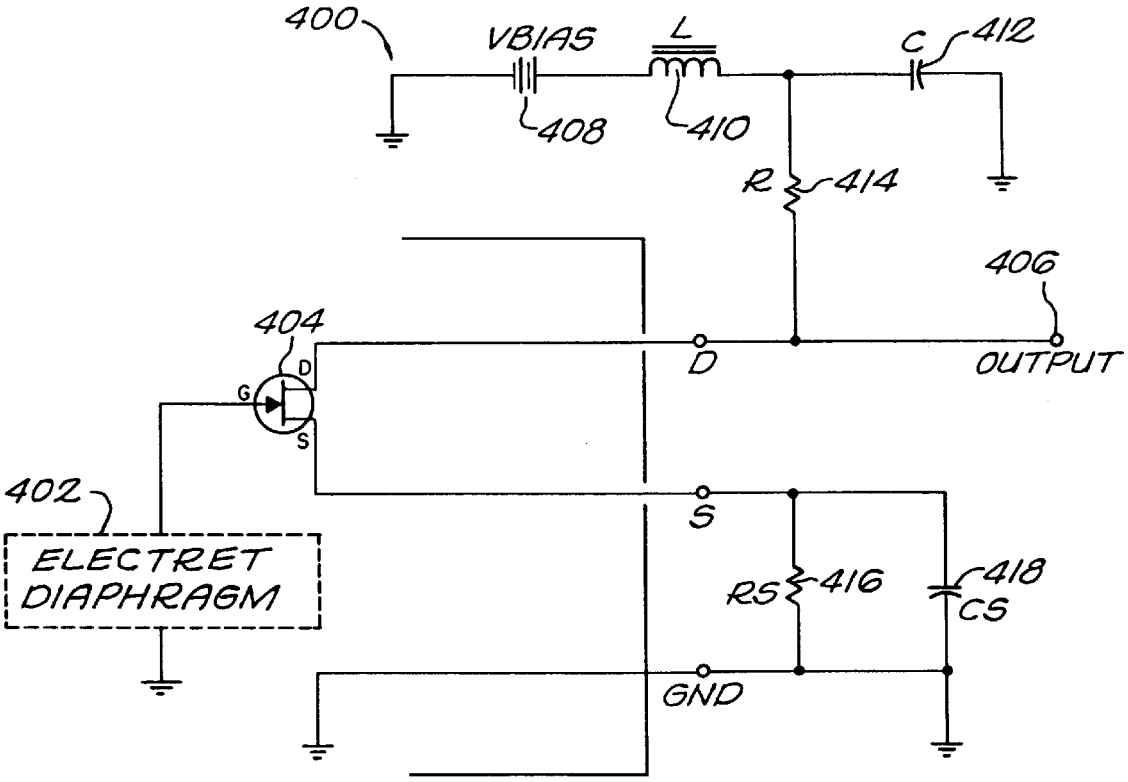
FIG. 4 is a schematic circuit diagram of an exemplary circuit in accordance with the invention.

FIG. 4 is a schematic circuit diagram of an exemplary circuit 400 in accordance with the invention. The circuit 400 includes an electret diaphragm element 402 coupled to the gate of a JFET 404. The drain of the JFET is connected to a drain node D which serves also as the circuit output 406. A series coupled string of a biasing voltage source 408, an inductor 410 and a capacitor 412 are coupled to the node D via a resistor 414. The source of the JFET is coupled to a source node S, which in turn is coupled to ground via a resistor 416 and a parallel connected capacitor 418.

In the series RL example of FIG. 4 (neglecting C), where R=2 KΩ as before and L=330 mH, the impedance magnitude at 1 kHz is approximately 4 kΩ. The drain impedance is doubled to thus obtain 6 dB of voltage gain without the power dissipation or noise penalty that would come with an active amplification stage after the mic output. The inductance value is large, but the inductor is in series with a large resistance. It will be recognized that low-cost lossy inductor construction with several hundred turns of fine wire resulting in a winding resistance of hundreds of ohms is acceptable. The loss can be readily absorbed by subtraction from resistor 414 of circuit 400.

The RL combination will result in a rising frequency response which is often desirable and specifically mandated in telephony. The response can be tailored or the rise limited beyond a certain frequency by the inclusion of capacitor 412. The LC resonance can be placed at that frequency, for instance with a capacitor of 10 nF the peak will occur at 2.8 kHz. Unlike tuned RLC circuits in radio frequency applications, low Q and avoidance of sharp peaks is required for an even mic circuit output level from a broad sample of human voices. Approximate circuit Q in this example is 0.35, obtained by dividing resistance by inductive reactance at 2.8 kHz.

Figure 5:
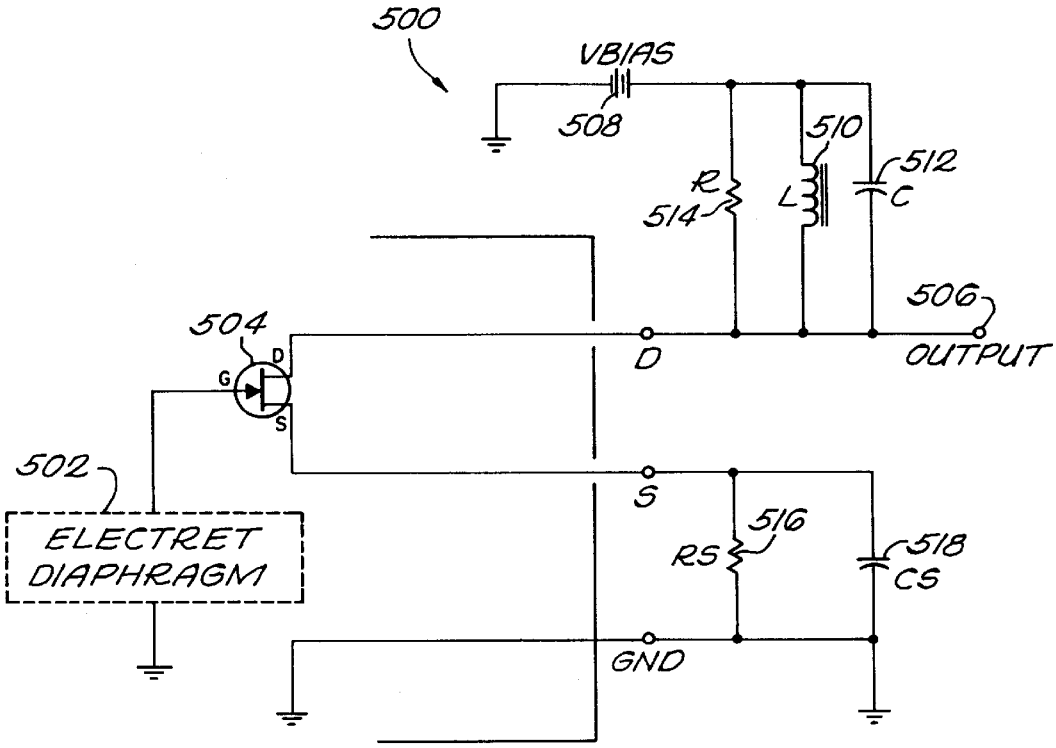
FIG. 5 is a schematic circuit diagram of a circuit in accordance with another exemplary embodiment of the invention.

Series-parallel network transformations can be applied to alter the circuit and derive additional benefits. FIG. 5 is a schematic circuit diagram of a circuit 500 in accordance with another exemplary embodiment of the invention. Circuit 500 has a parallel RLC circuit including a biasing voltage source 508, a resistor 514, an inductor 510 and a capacitor 512 coupled to the FET 504 drain node D. Here the voltage drop is minimized because the low resistance DC path for the drain current is through the inductor. Using 200 $\mu$A as a typical mic current, the voltage drop for the inductor and resistor values of the previous example will be only 200 $\mu$Ax(2 kΩ//200Ω)=36 mV. This is compared to the drop with the same components in the circuit 400 of FIG. 4, which is 200 $\mu$Ax(2 kΩ)=400 mV, and which may be too high in a portable low voltage application.

Figure 6:
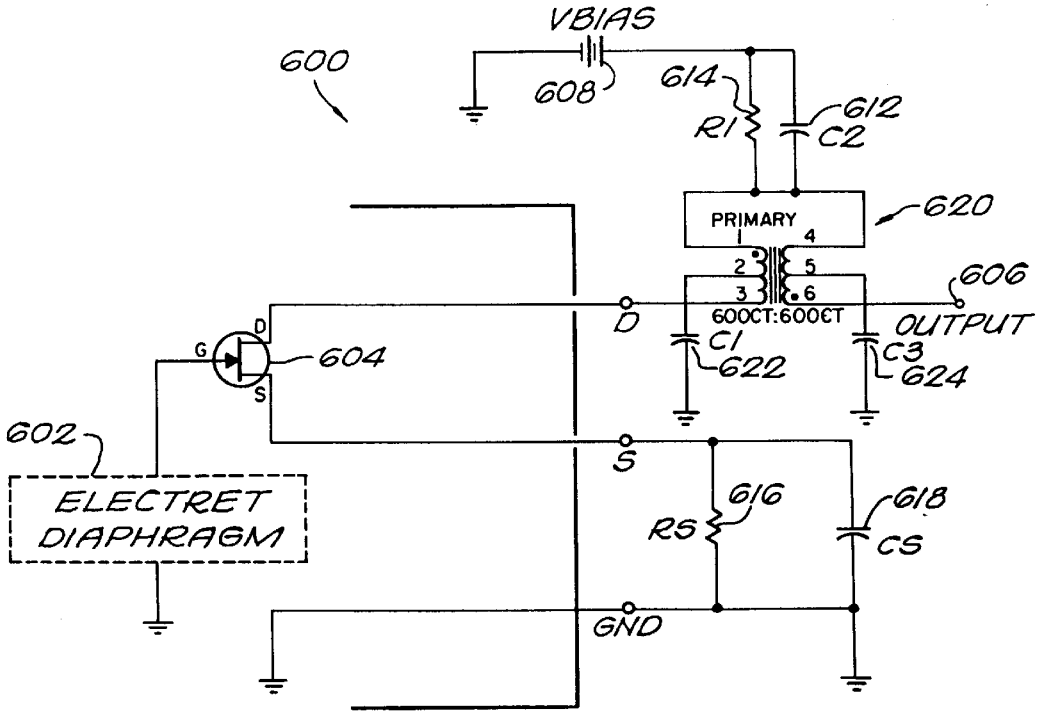
FIG. 6 is a schematic circuit diagram of a circuit in accordance with yet another exemplary embodiment of the invention.

More complex combinations of RLC components, tapped inductors or transformers may also be employed for achieving a flat frequency response in a band of interest, for example 300 Hz to 3 kHz for speech recognition. A well known miniature 600Ω center-tapped to 600Ω center-tapped transformer 620 from telephony can be used as in FIG. 6. FIG. 6 is a schematic circuit diagram of a circuit 600 in accordance with yet another exemplary embodiment of the invention. Circuit 600 has a RLC circuit including a biasing voltage source 608, a resistor 614, and a capacitor 612 coupled to the FET 604 drain node D, and which is coupled to ground via capacitors 622 and 624.

The windings of transformer 620 are connected as four consecutive inductors with three capacitors to form a low pass filter with low ripple and a sharp roll-off above the highest frequency of interest.

The performance of a simple two-terminal electret mic can be improved by separating the FET source terminal. The mic can then be used in the source follower mode at a lower current. The mic can also be used in the common source mode as before separating, but with greater current stability. The audio frequency output at the drain can be increased and shaped to suit the application with RLC components. Finally, the circuits described herein can also be applied to three-terminal electrets to further enhance their performance. The bias voltage source shown in the figures is a one-cell battery. Higher voltages up to the breakdown of the JFET, typically 40 V, are also appropriate since the drain current remains constant with increasing bias voltage.

The foregoing description has been set forth to illustrate the invention and is not intended to be limiting. Since modifications of the described embodiments incorporating the spirit and substance of the invention may occur to persons skilled in the art, the scope of the invention should be limited solely with reference to the appended claims and equivalents thereof.

What is claimed is:

1. An electret microphone circuit comprising:

an electret microphone including a field effect transistor (FET) having a gate coupled to an electret element, a drain coupled to provide audio frequency output to an audio output node, and a source coupled to ground via a first resistor so as to reduce drain current swings; and an RLC circuit coupled to said drain and to a bias voltage source, said RLC circuit configuring said audio frequency output from said drain to desired characteristics.

2. The circuit of claim 1, wherein a capacitor is coupled between said source and ground in parallel to said first resistor so as to increase the gain of said FET and the output of said electret microphone by operating said FET in common source mode.

3. The circuit of claim 1, wherein said RLC circuit comprises an inductor and a second resistor coupled in series between a bias voltage source and said drain.

4. The circuit of claim 1, wherein said RLC circuit comprises an inductor, a capacitor, and a second resistor coupled in parallel between a bias voltage source and said drain.

5. The circuit of claim 1, wherein said RLC circuit comprises at least one capacitor, a second resistor, and a transformer coupled between a bias voltage source and said drain.

6. The circuit of claim 1, wherein said RLC circuit comprises at least one capacitor, a second resistor, and at least two inductors coupled between a bias voltage source and said drain.

7. The circuit of claim 1, wherein said electret microphone comprises a two-terminal electret microphone.

8. The circuit of claim 1, wherein said electret microphone comprises a three-terminal electret microphone.

9. The circuit of claim 1, wherein said circuit operates with a lower voltage due to the reduction of drain currents.

10. An electret microphone circuit comprising:

an electret microphone including a field effect transistor (FET) having a floating gate connected only to an electret element, a drain coupled to a bias voltage source, and a source coupled to a ground via a single resistor so as to reduce drain current swings; and a circuit coupled to said FET for operating said FET in a source follower mode so as to create a low output impedance.

11. The circuit of claim 10, wherein said electret microphone comprises a two-terminal electret microphone.

12. The circuit of claim 10, wherein said electret microphone comprises a three-terminal electret microphone.

13. The circuit of claim 10, wherein said circuit operates with a lower voltage due to the reduction of drain currents.

14. A method of improving performance of an electret microphone, said microphone including a field effect transistor (FET) having a gate coupled to an electret element, a drain coupled to provide audio frequency output to an audio output node, and a source, said method comprising:

coupling said source to ground via a first resistor so as to reduce drain current swings; and configuring said audio frequency output from said drain to desired characteristics, including coupling an RLC circuit to said drain.

15. The method of claim 14 further comprising providing a capacitor coupled between said source and ground in parallel to said first resistor so as to increase gain of said FET by operating said FET in common source mode.

16. The circuit of claim 14, wherein said RLC circuit comprises an inductor and a second resistor coupled in series between a bias voltage source and said drain.

17. The circuit of claim 14, wherein said RLC circuit comprises an inductor, a capacitor, and a second resistor coupled in parallel between a bias voltage source and said drain.

18. The circuit of claim 14, wherein said RLC circuit comprises at least one capacitor, a second resistor, and a transformer coupled between a bias voltage source and said drain.

19. The circuit of claim 14, wherein said RLC circuit comprises at least one capacitor, a second resistor, and at least two inductors coupled between a bias voltage source and said drain.

20. The circuit of claim 14, wherein said electret microphone comprises a two-terminal electret microphone.

21. The circuit of claim 14, wherein said electret microphone comprises a three-terminal electret microphone.

* * * * *